US005833576A

United States Patent [19]

Henmi

[11] Patent Number: 5,833,576

[45] Date of Patent: Nov. 10, 1998

[54] PHYSICAL TRAINING DEVICE

[75] Inventor: Kazukiyo Henmi, Fukuoka-ken, Japan

[73] Assignee: Henmi Engineering Co., Ltd., Fukuoka, Japan

[21] Appl. No.: 780,758

[22] Filed: Jan. 8, 1997

[51] Int. Cl.[6] ..... A63B 22/00

[52] U.S. Cl. ..... 482/52; 52/182

[58] Field of Search ..... 422/52; 57/182, 57/190; 14/69.5

[56] References Cited

U.S. PATENT DOCUMENTS 5,369,921 12/1994 Glenn ..... 52/182

*Primary Examiner*—Lynne A. Reichard
*Attorney, Agent, or Firm*—Evenson, McKeown, Edwards & Lenahan, PLLC

[57] ABSTRACT

To provide a physical training device which enables walking exercise in safe environment in an unstrained posture, inclined plates 2 are made to span a floor and a base 1, steps 3 formed with an unevenness on the surface are installed on the inclined plates 2 at predetermined intervals and rails 4 are installed on the sides of the inclined plates 2 wherein projections may also be provided on rails 4.

1 Claim, 4 Drawing Sheets

PHYSICAL TRAINING DEVICE

BACKGROUND OF THE INVENTION

1. Field of the Invention

The present invention relates to a physical training device, particularly to a physical training device for the feet and waist.

2. Description of the Related Art

Appropriate exercise is indispensable for a healthy body and to forestall aging. Although walking along mountain trails is an excellent form of exercise, the weather or location for most urban dwellers makes this impossible. Further, although jogging is frequently seen in cities, there are concerns for safety from crime and traffic accidents.

Although it is wonderful that life expectancy has steadily been increasing due to progress in the medical sciences, it is ironic that this same progress reduces the opportunity to walk, and accelerates the aging and weakening of feet.

SUMMARY OF THE INVENTION

Hence, the problem to be solved by the present invention is to provide a device for restoring an unvigorous and unhealthy person to a healthy state through the daily exercise of feet in an urban setting, and particularly to provide a physical training device which enables walking exercises in safe environment.

In order to resolve the above-described problem, according to a physical training device of the present invention, members for making portions of a staircase extend in a predetermined width from rising portions thereof until they resist even footing, are installed at portions of the staircase having a required number of steps between successive upper and lower steps. An unevenness may be formed at portions of steps of the staircase, rails may be installed at both sides of the staircase and an unevenness may be provided on them.

The present invention extremely downsizes a mountain path and is provided with a structure by which an appropriate burden can be applied on the heart or the like, and a motion which strengthens the muscles at the soles of the feet is effected in the upward motion of the feet on the steps, whereas in the downward motion of the feet on the steps, feet can land on a lower step in a state where the knee is stretched, the ankle becomes parallel to the toe and the heel, and whereby the delicate knee ligament can be stretched. In this way, the ankle muscle is rarely hurt, and a person can continue exercise over a longer period of time (20 to 60 minutes). Further, bone cells are stimulated by applying the burden of the physical weight thereon, whereby the strengthening of bones is spurred.

Also, the effect of a finger-pressure therapy is achieved when the unevenness provided on the steps affects the soles of the feet. Even if a person is tired, they can readily train by walking up and down the steps while holding the rails, and in this way effect finger-pressure therapy to the hand through the unevenness of the rails.

Aged people are apt to walk tardily or with a shuffle. However, according to the invented device, their feet will not be caught by the steps even with the shuffling motion since the portions between the successive upper and lower steps are inclined and an unstrained height is set to the portions between the successive upper and lower steps in compliance with the user's age, whereby an aged person can readily use the device.

DESCRIPTION OF PREFERRED EMBODIMENTS

A specific explanation will be given of the present invention in reference to embodiments as follows.

Figure 1:
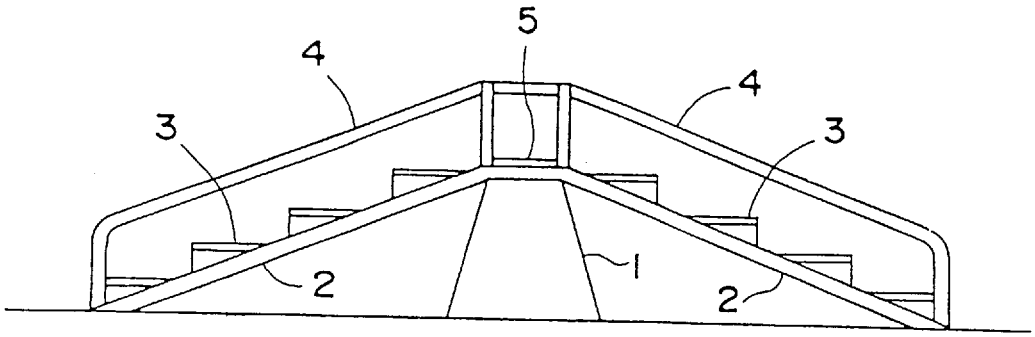
FIG. 1 is a front view showing a first embodiment of the present invention.
Figure 2:
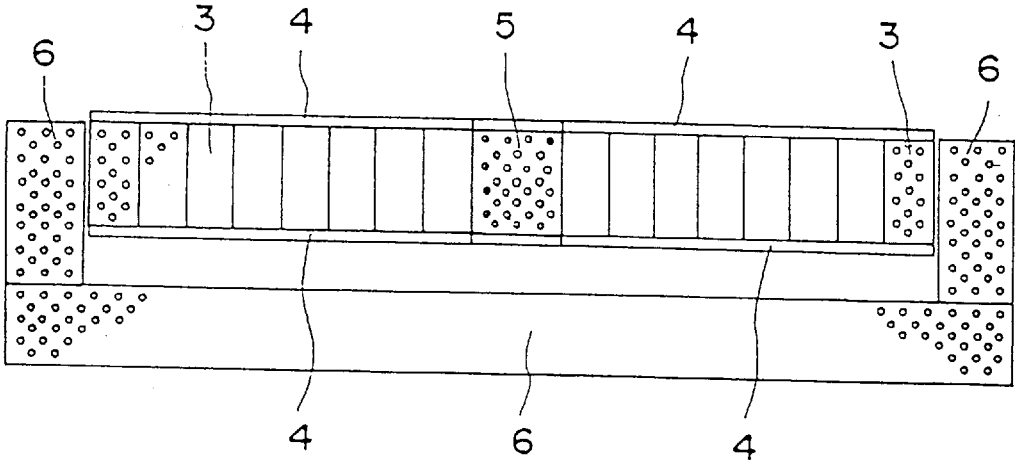
FIG. 2 is a plane view of the first embodiment of the present invention.

FIG. 1 is a front view showing a first embodiment of the present invention and FIG. 2 is a plane view thereof. In FIG. 1 and FIG. 2, numeral 1 designates a base, numeral 2 designates an inclined plate, numeral 3 designates a step, numeral 4 designates a rail, numeral 5 designates an uneven mat laid on the top face of base 1 and numeral 6 designates an uneven mat laid on a floor.

Figure 3:
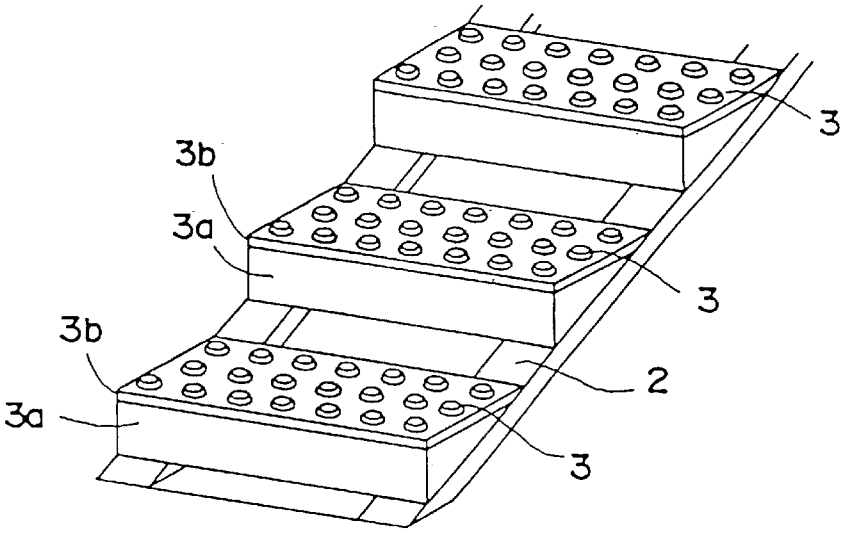
FIG. 3 is an enlarged perspective view showing portions of steps.

According to step 3, as illustrated in FIG. 3 an uneven plate 3*b* made of a rubber or plastic is fixed on a base 3*a* made of wood, plastic, metal etc. by adhesion or the like, and base 3*a* and uneven plate 3*b* may be integrated.

Figure 4:
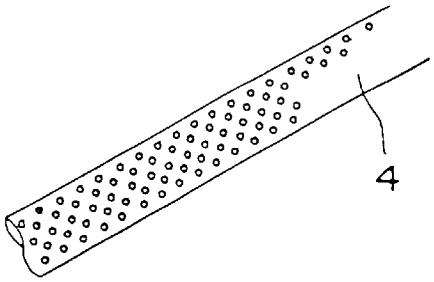
FIG. 4 is an enlarged perspective view showing a portion of a rail.

As illustrated in FIG. 4, a number of projections are provided on rail 4 by which the effect of finger-pressure therapy is provided to the hand when these projections are gripped.

Figure 5:
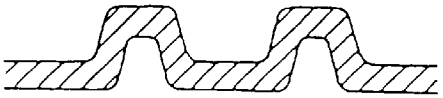
FIG. 5 is a sectional view of projected portions.
Figure 6:
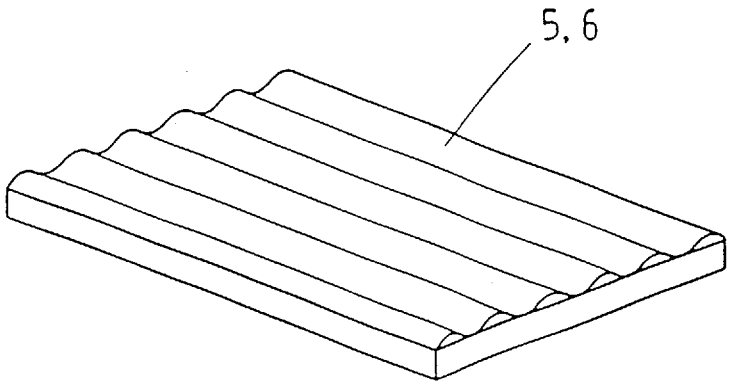
FIG. 6 is a perspective view showing an example of an uneven plate.

As illustrated in FIG. 5, with respect to projections of uneven plate 3*b* and uneven mats 5 and 6, the insides of the projections are hollow, by which pressure can be softly applied to the soles of the feet, thereby reducing pain even with repeat exercises. Or, as illustrated by FIG. 6, they may be constituted by plates made of rubber or plastic having a cushioning effect.

Figure 7:
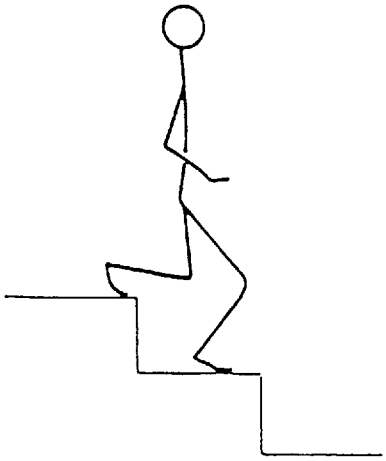
FIG. 7 is an explanatory view showing an example where the width of the steps and height intervals thereof are inappropriate.
Figure 8:
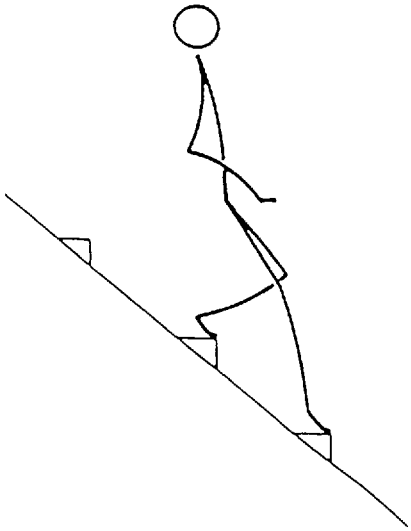
FIG. 8 is an explanatory view showing an example where the width of the steps and the height intervals are appropriate.

As to the width (depth) of the step and intervals in height, as illustrated by FIG. 7, when the intervals in the height of the step are smaller, it is said that knee problems can frequently result when a person is going down the steps. This is because, in the downward motion of feet on the steps, the knee joint is inclined forward and accordingly, when the knee is bent, physical weight is excessively applied on the ligament, thereby injuring it. In contrast thereto, in the case of the width and the intervals in the height of the steps as illustrated by FIG. 8, the feet land on the steps in a state where the feet are stretched even in the downhill motion and accordingly, the burden on the knee is alleviated and the ligament is rarely hurt.

According to the physical training device having the above-described constitution, training for preventing aging can be carried out even in a room by walking upwardly and downwardly on steps 3 and on the floor over uneven mat 6 for a predetermined period of time or a predetermined number of steps. Also, when a person walks upwardly and downwardly on the steps while holding rails 4, the projections press the hand whereby sensitive portions of the hand are stimulated and a prevention of senility is achieved.

Figure 9:
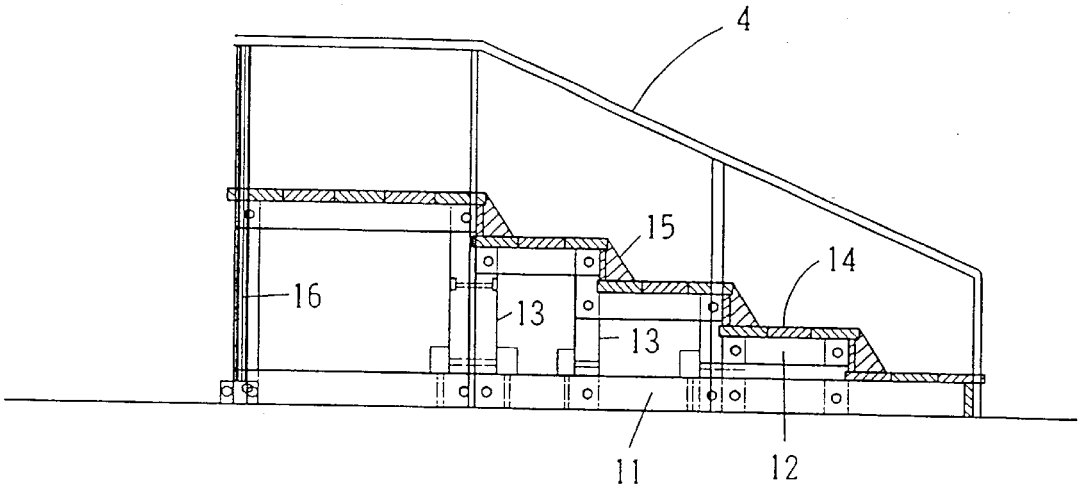
FIG. 9 is a front view showing a second embodiment of the present invention.
Figure 10:
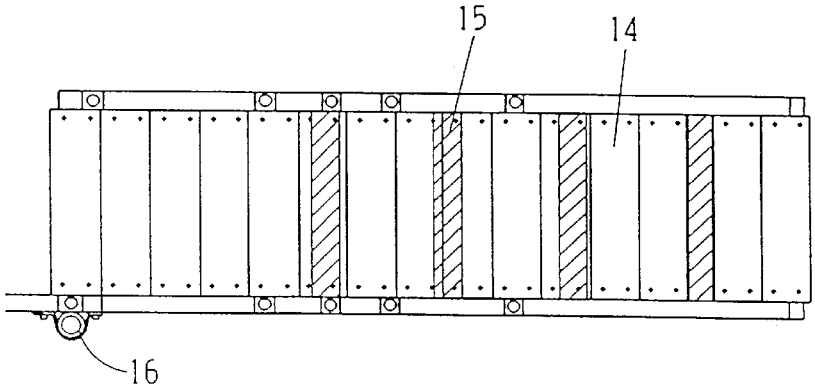
FIG. 10 is a plane view of the second embodiment of the present invention.

FIG. 9 is a side view showing a second embodiment of the present invention and FIG. 10 is a plane view thereof. According to the first embodiment, when the device is used by a heavy person, the inclined plates 2 are apt to be bent upwardly and downwardly causing unease. The second embodiment has been carried out in consideration of the above-described problem of the strength of the device. According to the second embodiment, the strength of the device is provided by supporting portions of respective steps of a staircase, and the device is of an assembling style that facilitates transportation. That is, base frames 11, step frames 12 and vertical frames 13 are connected by bolts, steps 14, where plastics such as wavy hard rubber or the like are adhered onto rubber or the like having a cushioning effect as illustrated by FIG. 6, are fixed on step frames 12 and members 15 (for prohibiting the landing of feet) having a triangular section are fixed onto portions of the staircase between successive upper and lower steps. The base frames 11, step frames 12 and vertical frames 13 are manufactured by wood, metal, FRP (fibre-reinforced plastic), plastic or the like.

Figure 11:
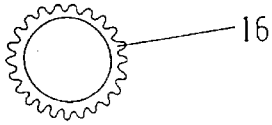
FIG. 11 is a plane view of a wrist training rod.

Incidentally, numeral 16 in FIG. 9 designates a wrist training rod for training the muscle of the wrist, and has a wavy surface as illustrated by FIG. 11 for preventing the hand from slipping in a twisting direction when the body is twisted while gripping the wrist training rod 16 by the hand reversed downwardly. The wrist training rod 16 is attached to the main body with a gap therebetween.

When the height of the device is intended to be increased in the second embodiment, a base 17 made of wood or plastic is laid beneath the base frames 11 whereby the height is increased by the same part.

As has been described, according to the present invention, members for prohibiting the landing of feet are provided at portions of the staircase extending in a predetermined width from the rise portions thereof at the portions between the successive upper and lower steps of the staircase having a required number of steps. Accordingly, excessive force is not applied on the ligament when a person walks down the staircase, by which the muscle of the ankle and the like are rarely hurt, and whereby a person can tolerate extended exercise. Further, the circulation of blood is improved by stimulating the sensitive portions on the soles of the feet by providing the unevenness on the steps. Exercise can freely be practiced even in bad weather, or when harmful ultraviolet rays need to be avoided, or in an environment where crime is a concern. Further, the exercise can readily be practiced at any time with no concern for traffic accidents, whereby the recovery of physical strength can be achieved. The device is adaptable to a wide variety of generations and the deterioration of feet can be greatly reduced, thus allowing an elderly person to have a more comfortable life.

What is claimed is:

1. A physical training device comprising:

a plurality of successive steps, including an uppermost step, a lowermost step, and intermediate steps, defining a staircase, rise portions provided between adjacent successive steps;

members for making portions of said intermediate steps extending a predetermined width from said rise portions incapable of contact by feet, said members being installed between successive steps in the staircase, rails installed at both sides of the staircase, and projections provided on the rails.

* * * * *